US007932914B1

(12) United States Patent
Geiss et al.

(10) Patent No.: US 7,932,914 B1
(45) Date of Patent: Apr. 26, 2011

(54) STORING HIGH DYNAMIC RANGE DATA IN A LOW DYNAMIC RANGE FORMAT

(75) Inventors: Ryan M. Geiss, Santa Cruz, CA (US); Mehmet Cem Cebenoyan, Palo Alto, CA (US)

(73) Assignee: NVIDIA Corporation, Santa Clara, CA (US)

( * ) Notice: Subject to any disclaimer, the term of this patent is extended or adjusted under 35 U.S.C. 154(b) by 1588 days.

(21) Appl. No.: 11/254,385

(22) Filed: Oct. 20, 2005

(51) Int. Cl.
*G09G 5/00* (2006.01)

(52) U.S. Cl. ..... 345/660; 345/555; 345/614

(58) Field of Classification Search ..... 345/660
See application file for complete search history.

(56) References Cited

U.S. PATENT DOCUMENTS 6,058,217 A * 5/2000 Kondo ..... 382/251
6,919,904 B1 * 7/2005 Kilgariff ..... 345/582
7,308,135 B2 * 12/2007 Spaulding et al. ..... 382/162
2003/0202589 A1 * 10/2003 Reitmeier et al. ..... 375/240.12
* cited by examiner

*Primary Examiner* — Xiao M Wu
*Assistant Examiner* — Maurice McDowell, Jr.
(74) *Attorney, Agent, or Firm* — Patterson & Sheridan, LLP

(57) ABSTRACT

Systems and methods for storing high dynamic range image data in a low dynamic range format may be used to store the high dynamic range image data in less memory. The memory bandwidth needed to access the high dynamic range data is reduced and processing performance may be improved when performance is limited by memory bandwidth. The high dynamic range image data is scaled and compressed into a low dynamic range format for storage in a render target. If the compressed high dynamic range image data contains multiple data samples per pixel, the data may be processed to produce filtered compressed high dynamic range image data with only one sample per pixel. The high dynamic range image may be reconstructed from the low dynamic range format data and further processed as high dynamic range format data for a range of applications.

25 Claims, 12 Drawing Sheets

STORING HIGH DYNAMIC RANGE DATA IN A LOW DYNAMIC RANGE FORMAT

BACKGROUND OF THE INVENTION

1. Field of the Invention

Embodiments of the present invention generally relate to compression of high dynamic range image data and, more specifically, to compressing high dynamic range image data into a low dynamic range format for storage in a render target.

2. Description of the Related Art

Conventionally high dynamic range image data is stored in a floating point format buffer. Conventionally low dynamic range image data is stored in a fixed point format buffer of fewer bits per pixel, and therefore the low dynamic range image data is stored in less memory than the high dynamic range image data. Reducing memory requirements may reduce system cost or permit more buffers to be stored in the same amount of memory. Less memory bandwidth is needed to access the low dynamic range image data compared with accessing the high dynamic range image data. Performance may be improved when low dynamic range image data is used and the system performance is memory bandwidth limited.

Accordingly, it is desirable to store high dynamic range image data in a format that requires less memory than conventional high dynamic range buffer.

SUMMARY OF THE INVENTION

The current invention involves new systems and methods for storing high dynamic range image data in a low dynamic range (LDR) format. The LDR format requires less memory compared with the memory needed to store the high dynamic range (HDR) image data. The memory bandwidth needed to access the HDR image data is reduced and processing performance may be improved when performance is limited by memory bandwidth. The HDR image data is synthesized (rendered), sometimes using multi-sample anti-aliasing, and then compressed into an LDR format, i.e., non-floating point, for storage in an LDR render target. When multi-sample anti-aliasing is used to synthesize the HDR image data, the compressed HDR image data includes compressed HDR sub-pixel sample data for each pixel of the HDR image. The compressed sub-pixel samples for each pixel can be combined to create filtered compressed HDR image data with only one sample per pixel. Reconstructed HDR image data can be produced by decompressing the filtered compressed HDR image data or decompressing the compressed HDR image data. Post processing functions, e.g., tone mapping, exposure adaption, blue shift, blur, bloom, edge glow, depth of field, and the like, may be performed on the reconstructed HDR image data.

Various embodiments of a method of the invention for storing high dynamic range image data in a low dynamic range render target include receiving the high dynamic range image data for a fragment that includes multiple channels, determining a maximum channel value of the multiple channels, processing the multiple channels and the maximum channel value to produce compressed channel values, and storing the compressed channel values in the low dynamic range render target.

Various embodiments of the invention include a system for storing high dynamic range image data in a low dynamic range render target including a channel scale unit, a format conversion unit, and a memory. The channel scale unit is configured to receive the high dynamic range image data and produce scaled channel values and a maximum channel value for a fragment. The format conversion unit is coupled to the channel scale unit and is configured to convert the scaled channel values and the maximum channel value into a low dynamic range format to produce compressed high dynamic range channel values and a compressed maximum channel value for the fragment. The memory is configured to store the compressed high dynamic range channel values and the compressed maximum channel value in the low dynamic range render target.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

The conversion scheme may be used to compress HDR data to an LDR format, thereby reducing the memory requirements needed to store the HDR data. HDR values are not limited to a range between 0 and 1, inclusive, and are typically represented in a floating point format. Therefore, HDR values may be greater than 1. In contrast, LDR values are limited to a range between 0 and 1, inclusive, and are typically represented in a fixed point format. Using techniques of the present invention, 16 bit per channel HDR data may be compressed to an 8 bit per channel LDR format, sometimes halving the memory requirement. Multisampled HDR data, including multiple sub-pixel samples for each pixel, may also be compressed to an LDR format. The compressed HDR data may be reconstructed without loss for channel values less than one. Channel values greater than one may have small losses that are not easily perceived by a user. The compressed HDR image data may be processed, i.e., decompressed, to produce HDR image data. Compressed HDR image data that was produced by filtering compressed multisampled HDR data will result in reconstructed HDR image data that has the visual benefit of anti-aliasing. Post processing functions, e.g., tone mapping, exposure adaption, blue shift, blur, bloom, edge glow, depth of field, and the like, may also be performed on the reconstructed high dynamic range image data.

Figure 1:
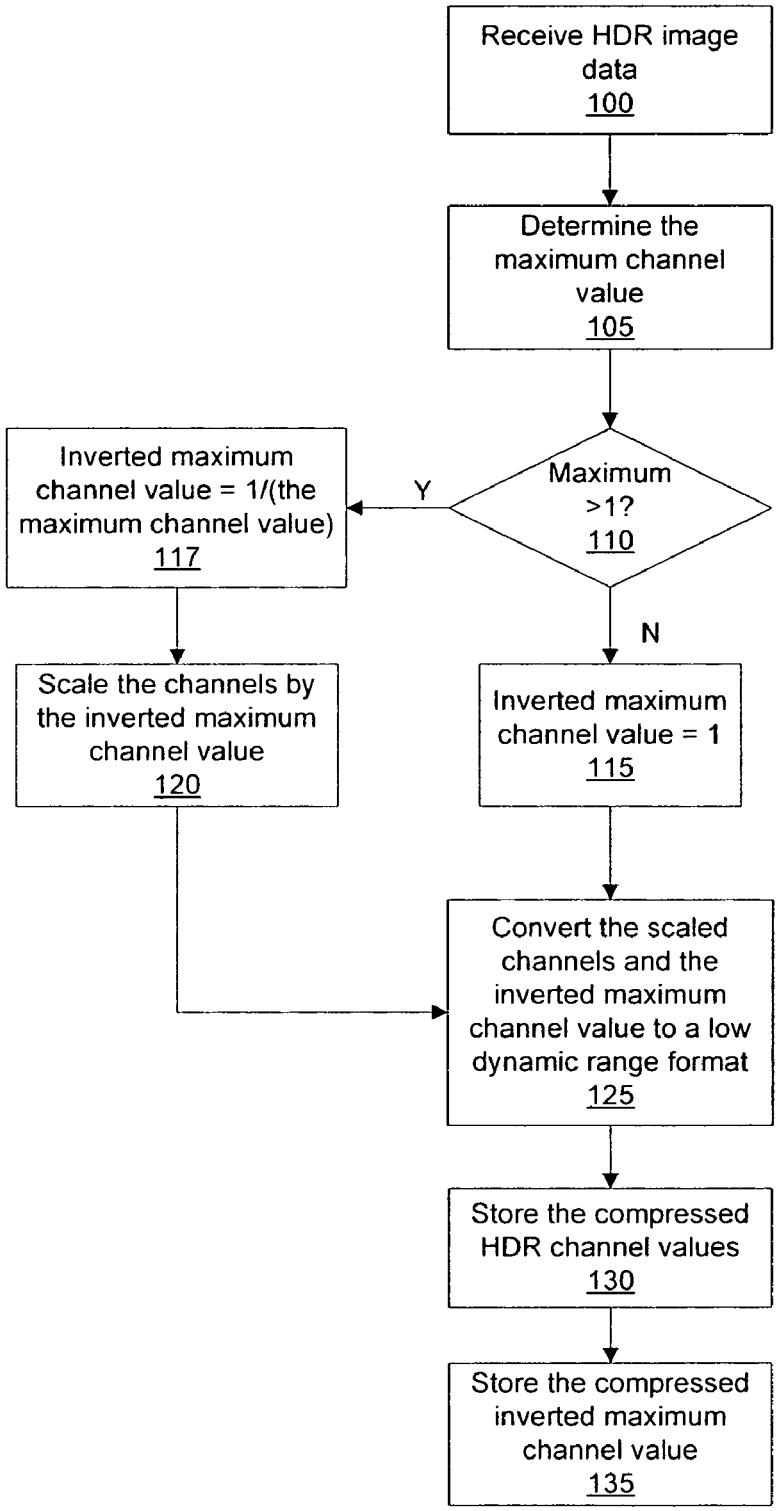
FIG. 1 illustrates a flow diagram of an exemplary method of compressing high dynamic range image data for storage in a low dynamic range format render target in accordance with one or more aspects of the present invention.

FIG. 1 illustrates a flow diagram of an exemplary method of compressing high dynamic range (HDR) image data for storage in a low dynamic range format render target in accordance with one or more aspects of the present invention. In step 100 HDR image data for a fragment is received. A fragment is produced by the intersection of a graphics primitive with a pixel and the fragment may cover the entire pixel or a portion, i.e., some number of sub-pixel samples, of the pixel. The HDR image data is typically represented in a floating point format, e.g., float 16, float 32, or the like, and may include color channels, alpha channels, depth, texture coordinates, and other fragment specific parameters. Although the present invention is described in the context of compressing color channel HDR image data, the present invention is not limited to color HDR image data. Other types of HDR image data may include alpha, depth, lighting information, normal vectors, intermediate data produced by a shader program, texture coordinates, or the like.

In step 105 the method determines the maximum channel value included in the HDR image data for the fragment. The color channels of LDR image data are limited to a maximum value of one. Unlike LDR image data, the color channels of HDR image data can have values greater than one. In step 110 the method determines if the maximum channel value is greater than one, and, if not, then in step 115 an inverted maximum channel value is set to one. The inverted maximum channel value is computed as the reciprocal of the maximum channel value. If, in step 110 the method determines that the maximum channel value is greater than one, then in step 117 the inverted maximum channel value is computed as the reciprocal of the maximum channel value and the method proceeds directly to step 125. In step 120 the method scales the channels representing color data, e.g., RGB (red, green, blue), YUV, or the like, by the inverted maximum channel value. Note that when the maximum channel value determined in step 105 is not greater than one, that the color channels will not be changed in step 120.

In step 125 the method converts the scaled channels and the inverted maximum channel value to an 8-bit-per-channel fixed-point (LDR) format to produce compressed HDR channel values. In some embodiments of the present invention, the scaled channels and the inverted maximum channel value are each computed as 16 bit floating point values that are converted into 8-bit-per-channel fixed-point values prior to being stored in the 8-bit-per-channel (LDR) render target. In step 130 the method stores the compressed HDR channel values in an LDR render target. Specifically, the compressed channel values are stored in a pixel location corresponding to the fragment. The LDR render target requires less memory than an HDR render target of the same pixel resolution since fewer bits are stored for each pixel in an LDR render target. In step 135 the method stores the compressed inverted maximum channel value. The compressed inverted maximum channel value may be stored in the same render target as the compressed HDR channel values or in a different render target. In some embodiments of the present invention the compressed inverted maximum channel value is stored in the alpha channel of the pixel location corresponding to the fragment.

In some embodiments of the present invention, shader program instructions may be used to perform steps 105, 110, 115, 117, and 120. The code shown in Table 1 represents such shader program instructions, where color is the color value generated by the previous instructions of the shader program. t is used to store the computed maximum channel value and then the converted reciprocal of the maximum channel value. Note that the saturate command performs steps 110, 115, and 117. color.xyz represents three color channels and half is a 16 bit per pixel floating point format. By way of illustration, the code is defined using Cg or HLSL (high-level shader language). However, any other language may be used to define the function.

TABLE 1

```
half t = max( max(color.x, color.y), color.z );
t = saturate(1.0/t);
return half4 (color.xyz, 1) * t;
```

The code shown in Table 2 represents other shader program instructions that may be used to perform steps 105, 110, 115, 117, and 120. A cubemap texture lookup is used to determine the maximum color channel value and scale the color channels by the reciprocal of the maximum color channel value. Specifically, three color channels are used to index a cubemap (called cubeTex) that stores the coordinates of a 2×2×2 cube centered on the origin with each coordinate ranging in value from −1 to 1. The value returned by the cubemap lookup is the scaled color channel values. scaled.xyz represents the three scaled color channels, where each channel value is scaled up or down by the maximum channel value so that the maximum scaled color channel value is one. The reciprocal of the maximum channel value is then computed and stored in t. By way of illustration, the code is defined using Cg or HLSL. However, any other language may be used to define the function.

TABLE 2

```
half3 scaled h3texCUBE (cubeTex, color.xyz );
half t = saturate( scaled.x/color.x);
return half4 (scaled.xyz, t );
```

The shader program instructions shown in Table 1 or Table 2 may be added to the end of a shader program to compress HDR image data into an LDR format for storage in the render target.

Figure 2A:
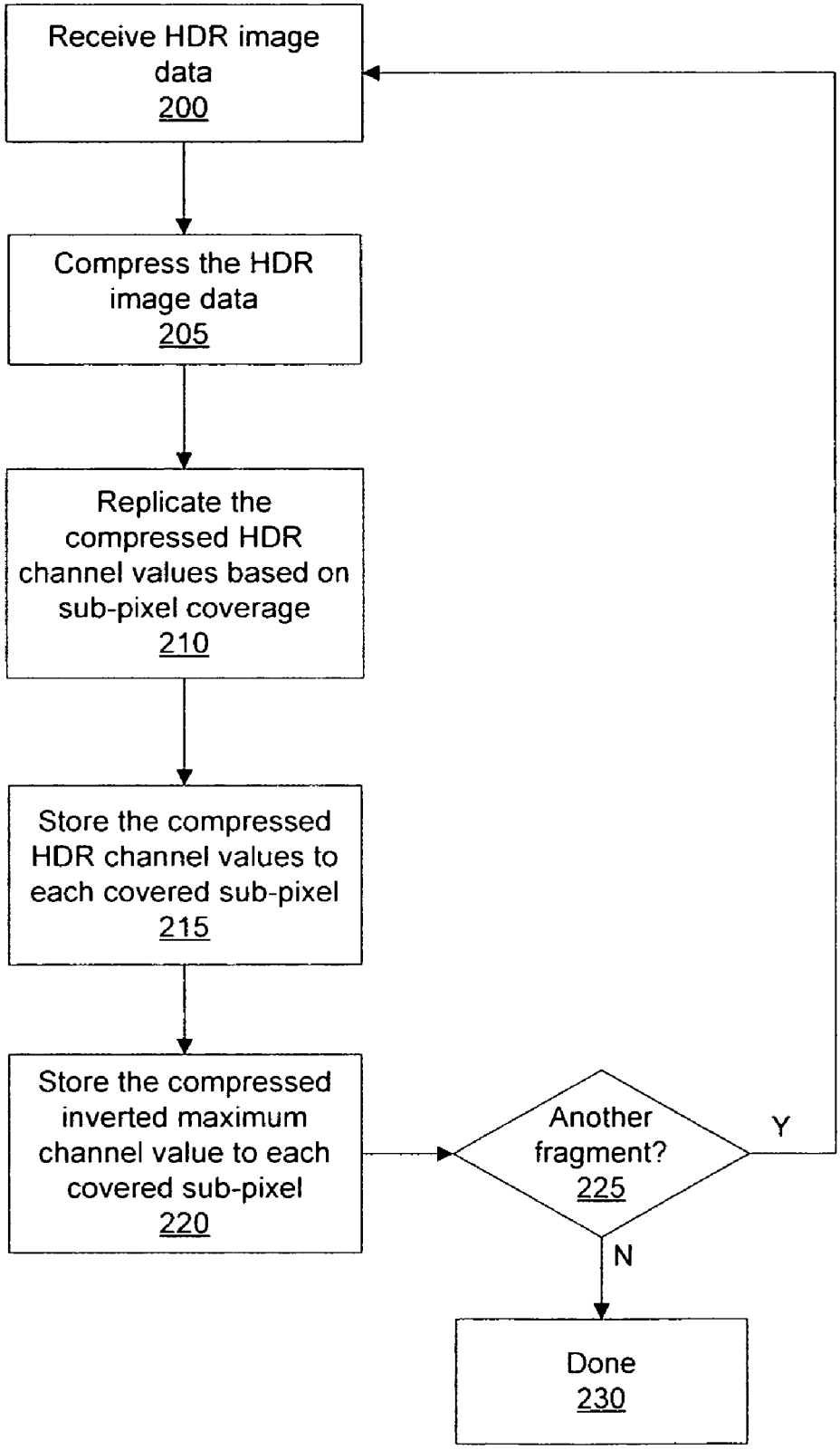
FIG. 2A illustrates a flow diagram of an exemplary method of compressing optionally multisampled high dynamic range image data for storage in a low dynamic range format render target in accordance with one or more aspects of the present invention.

FIG. 2A illustrates a flow diagram of an exemplary method of compressing multisampled HDR image data for storage in a multisampled LDR format render target in accordance with one or more aspects of the present invention. This method of the present invention produces a sub-pixel resolution render target including compressed multisampled HDR image data that may be used to produce an anti-aliased image represented in a compressed HDR format, an HDR format, or an LDR format, as described in conjunction with FIG. 2B. When a single sub-pixel sample is used for each pixel the method shown in FIG. 2A may produce compressed HDR image data that is equivalent to the compressed HDR image data produced using the method shown in FIG. 1.

In step 200 HDR image data for a fragment is received. The HDR image data includes a coverage mask produced during rasterization. The coverage mask indicates which sub-pixel positions of the pixel are covered by the fragment. In step 205 the HDR image data is compressed to an LDR format, as described in conjunction with FIG. 1 (steps 105, 110, 115, 117, 120, and 125), to produce compressed HDR channel values. In step 210 the method replicates the compressed HDR channel values based on the sub-pixel coverage of the fragment that is specified by the coverage mask received in step 200. For example, the compressed HDR channel values are replicated for each sub-pixel position of the pixel that is covered by the fragment. When an integer, N, sub-pixel positions are used for the pixel, the compressed HDR data may be copied to zero, one, or as many as N sub-pixel positions.

In step 215 the method stores the compressed HDR channel values in one or more sub-pixel positions of an LDR render target. In step 220 the method stores the compressed inverted maximum channel value in one or more sub-pixel positions. The compressed inverted maximum channel value may be stored in the same LDR render target as the compressed HDR channel values or the compressed inverted maximum channel value may be stored in an auxiliary LDR render target.

In step 225, the method determines if another fragment should be processed to produce the HDR image. If, in step 225, the method determines that another fragment should be processed, then the method returns to step 200. If, in step 225, the method determines that another fragment should not be processed, then the method proceeds to step 230 and the compressed multisampled HDR image is complete.

Figure 2B:
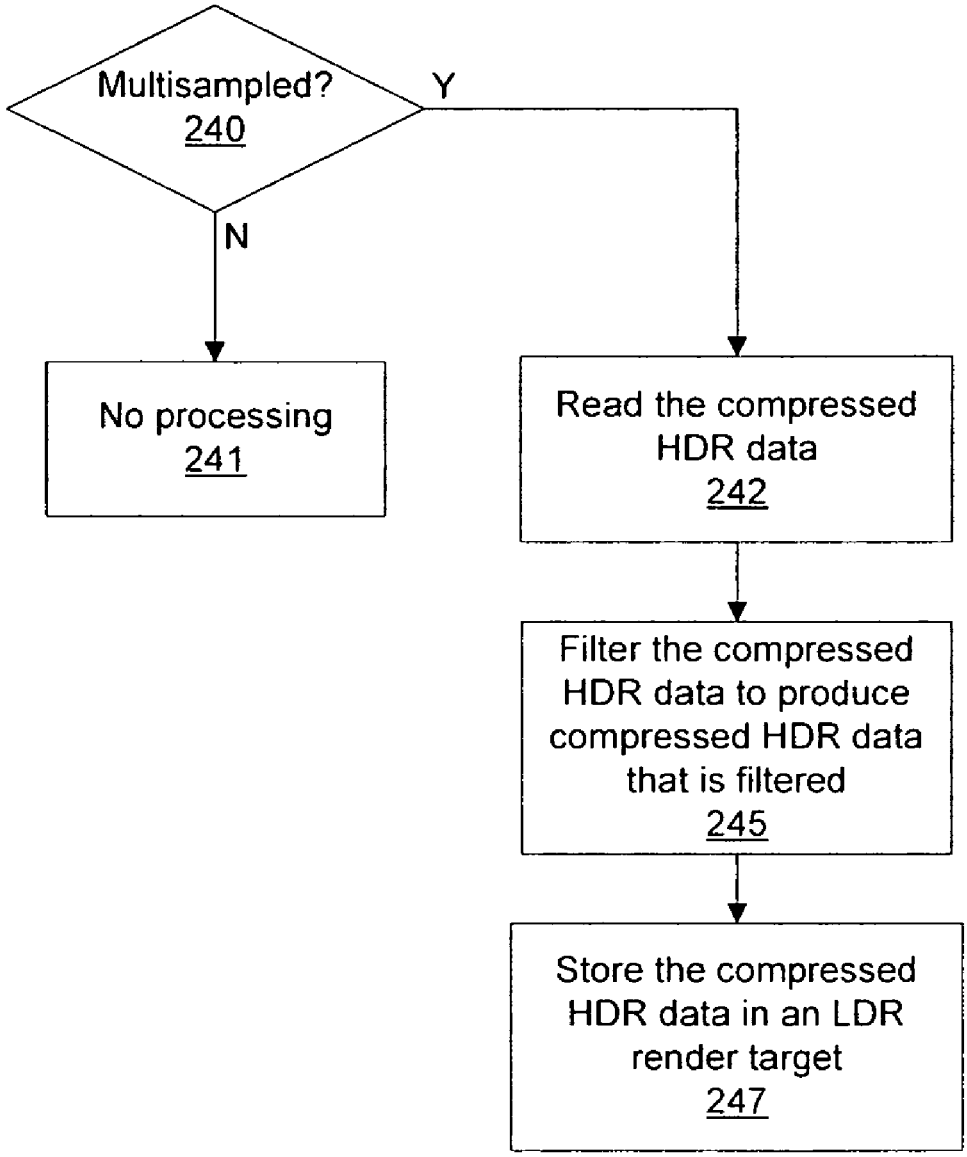
FIG. 2B illustrates a flow diagram of an exemplary method of filtering multisampled compressed high dynamic range image data stored in a multisampled low dynamic range format render target and producing filtered compressed high dynamic range image data in accordance with one or more aspects of the present invention.

FIG. 2B illustrates a flow diagram of an exemplary method of filtering HDR image data stored in an LDR format render target to produce filtered compressed HDR image data in accordance with one or more aspects of the present invention. The HDR image data may be multisampled HDR image data that includes compressed sub-pixel sample channel values and compressed sub-pixel inverted maximum channel values for each pixel of the HDR image. In step 240, the method determines if the compressed HDR data is multisampled, and, if so, in step 242 the method reads the compressed HDR data, e.g., compressed channel values and the compressed inverted maximum channel values, for each pixel from memory. When compressed multisampled HDR image data is stored in the render target, the compressed HDR data read from memory includes compressed HDR data for all of the sub-pixel samples within each pixel. In some embodiments of the present invention, the compressed HDR data may be read as texture data sampled from a render target. For example, compressed HDR data may be read from a render target produced using the method described in conjunction with FIG. 2A. If, in step 240, the method determines that the compressed HDR data is not multisampled, then the method proceeds directly to step 241 and the compressed HDR data is not filtered.

In step 245 the method filters the compressed sub-pixel HDR data for each pixel to produce filtered pixels, e.g., filtered channel values represented in the compressed HDR format. In some embodiments of the present invention, the compressed sub-pixel HDR data is downsampled to produce anti-aliased HDR data. In other embodiments of the present invention, other filtering techniques, known to those skilled in the art are used to produce the filtered pixels in the compressed HDR format. Note that the compressed multisampled HDR data is not necessarily decompressed before it is filtered to produce filtered compressed HDR data. Therefore, the filtered compressed HDR data is represented in the compressed HDR data format and may be processed in the same manner as compressed HDR data that is not multisampled, e.g. compressed HDR data produced using the method described in conjunction with FIG. 1. An HDR image reconstructed from filtered compressed HDR image data will benefit from the filtering, e.g., anti-aliasing, and may be considered a higher-quality image when compared with an HDR image reconstructed from compressed non-multisampled HDR image data. In step 247 the compressed HDR data that was filtered in step 245 is stored in an LDR format render target. In some embodiments of the present invention, step 247 is omitted and the compressed HDR data produced in step 247 is further processed. In some embodiments of the present invention shader program instructions may be used to perform steps 240, 241, 242, 245 and 247.

Figure 2C:
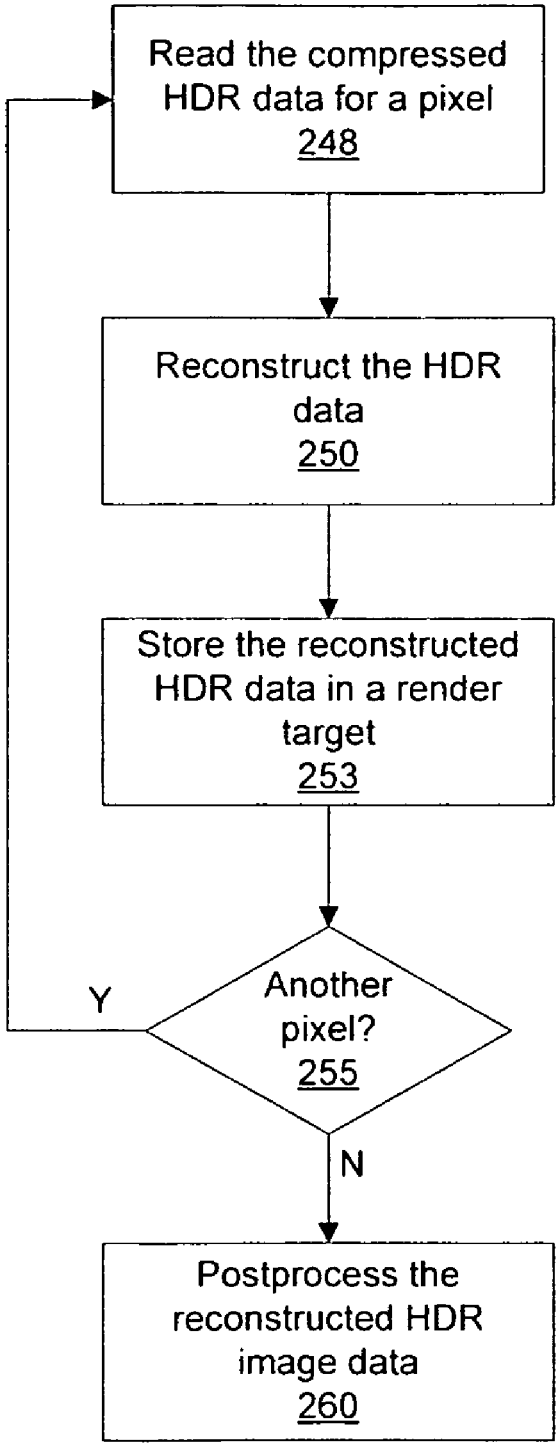
FIG. 2C illustrates a flow diagram of an exemplary method of reconstructing high dynamic range image data stored in a low dynamic range format render target and producing reconstructed high dynamic range image data in accordance with one or more aspects of the present invention.

FIG. 2C illustrates a flow diagram of an exemplary method of reconstructing HDR image data stored in a LDR format render target in accordance with one or more aspects of the present invention. In step 248 the method reads the compressed HDR data, e.g., compressed channel values and the compressed inverted maximum channel value, for a pixel from memory. The compressed HDR image data can be compressed HDR image data produced using the method described in conjunction with FIG. 1 or compressed HDR image data that was filtered using the method described in conjunction with FIG. 2B. In either case, the compressed HDR image data includes a compressed channel value and a compressed inverted maximum channel values for a single sample of each pixel of the HDR image. In some embodiments of the present invention, the compressed HDR data may be read as texture data sampled from a render target.

In step 250 the method reconstructs the HDR channel values from the compressed HDR data. Specifically, the compressed channel values and compressed inverted maximum channel value are each converted into a floating point data format. The floating point channel values are then divided by the floating point inverted maximum channel value to produce reconstructed HDR channel values.

In some embodiments of the present invention shader program instructions may be used to perform steps 248 and 250. The code shown in Table 3 represents such shader program instructions, where samp is the compressed HDR data read from memory. samp.xyz represents three color channels and samp.w represents the compressed inverted maximum channel value. By way of illustration, the code is defined using Cg or HLSL. However, any other language may be used to define the function.

TABLE 3

```
half4 samp = h4tex2D( texture, v2f.texcoord );
return half4 (samp.xyz/samp.w, 1);
```

When the compressed inverted maximum channel value is stored in a different render target than the compressed channel values, another texture read is used to acquire the compressed inverted maximum channel value.

In step 253 the reconstructed HDR channel values are stored in a true HDR render target. In some embodiments of the present invention, the reconstructed HDR image data may be compressed to an LDR format and stored in an LDR render target and reconstructed prior to performing the post processing functions. In step 255 the method determines if another pixel should be processed, and, if so, the method returns to step 248. Steps 248, 250, and 253 are repeated for each pixel in the HDR image in order to produce a reconstructed HDR image. If, in step 255 the method determines that another pixel should not be processed, then in step 260 the method proceeds to post process the reconstructed HDR image data using techniques known to those skilled in the art. Examples of post processing functions that may be performed on the reconstructed HDR image data by a shader program include tone mapping, exposure adaption, blue shift, blur, bloom, edge glow, depth of field.

Figure 3A:
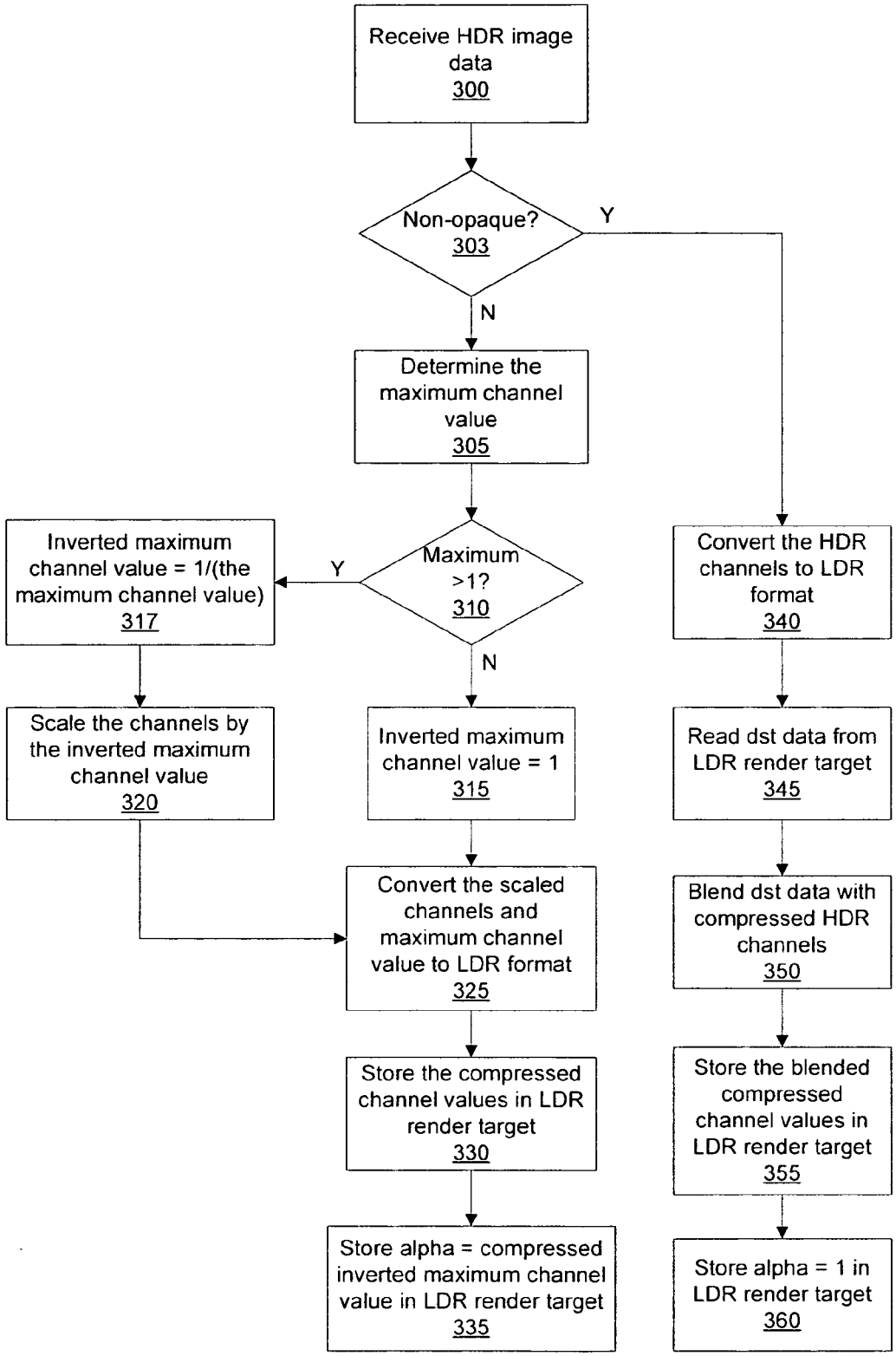
FIGS. 3A and 3B illustrate flow diagrams of other exemplary methods of compressing high dynamic range image data for storage in a low dynamic range format render target in accordance with one or more aspects of the present invention.

The method of compressing HDR image data into an LDR format described in conjunction with FIG. 2A may be adapted to include support for blending of non-opaque fragments. FIG. 3A illustrates a flow diagram of an exemplary method of compressing non-opaque HDR image data for storage in a LDR format render target in accordance with one or more aspects of the present invention. In step 300 HDR image data for a fragment is received. In step 305 the method determines if the HDR image data indicates that the fragment is non-opaque, i.e., if alpha is less than one, and, if so, the method proceeds to step 340. In some embodiments of the present invention, in step 305, the method also determines if a processor receiving the HDR image data is configured to interpret alpha values as opacity values for blending with a destination render target. If, in step 303 the method determines that the fragment is opaque, then the method proceeds to step 305 and determines the maximum channel value.

In step 315 the method determines if the maximum channel value is greater than one, and, if so, the method proceeds to step 317. Steps 310, 315, 317, 320, 325, and 330 are performed as described in conjunction with steps 110, 115, 117, 120, 125, and 130 of FIG. 1, respectively. When sub-pixel positions are used, a step may be included between steps 325 and 330 to replicate the compressed HDR channel values according to the fragment coverage information. In step 335 the compressed inverted maximum channel value is stored in the alpha channel of the pixel that is at least partially covered by the fragment. The compressed HDR channel values and compressed inverted maximum channel value are stored in one LDR render target. In some embodiments of the present invention, the compressed HDR channel values and compressed inverted maximum channel value may be replicated according to a sub-pixel coverage mask, as previously described in conjunction with FIG. 2A to produce compressed multisampled HDR image data.

When the fragment is non-opaque the method completes steps 340, 345, 350, 355, and 360. In step 340 the HDR channels are converted to an LDR format to produce compressed HDR channel values. When sub-pixel positions are used, a step may be included between steps 340 and 345 to replicate the compressed HDR channel values according to the fragment coverage information. In step 345 destination (dst) data for the pixel corresponding to the fragment, e.g., compressed HDR data, is read from the LDR render target. In step 350 the destination data is blended with the compressed HDR channel values, using conventional alpha blending techniques known to those skilled in the art, to produce blended compressed HDR channel values. Because the destination data is not reconstructed to an HDR format and the blend operation is performed at LDR precision, the blended compressed HDR channel values are limited to LDR values. Specifically, the blended compressed HDR channel values are each limited to a maximum value of one before and after the blended compressed HDR channel values are reconstructed.

In step 355 the blended compressed channel values are stored in an LDR render target. In step 360 a value of one is stored in the alpha channel of the pixel location of the LDR render target that is at least partially covered by the fragment. Although this method does not maintain the HDR range (i.e. compressed colors whose original maximum channel value was greater than 1 are scaled to be less than or equal to 1) for pixels that include non-opaque, i.e., transparent, fragments, it is compatible with graphics hardware that does not include support for reconstruction of HDR values for alpha blending. Therefore, LDR render targets may be used to produce images with HDR range for pixels that do not include non-opaque fragments using graphics hardware with support for conventional alpha blending. When support for reconstruction of HDR values is available, the method of processing HDR image data, including non-opaque fragments that is described in conjunction with FIG. 3B may be used to perform HDR range alpha blending.

Figure 3B:
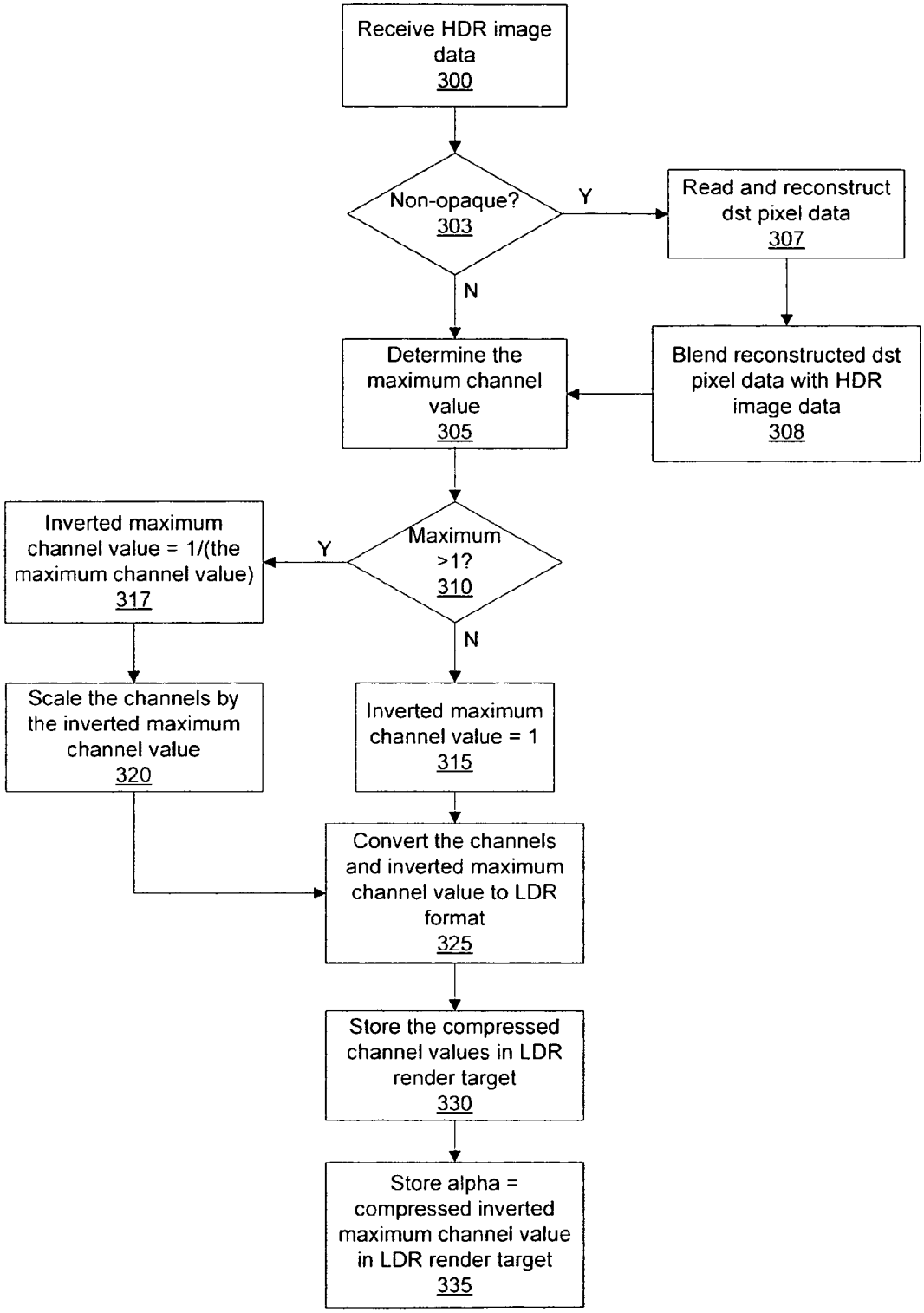

FIG. 3B illustrates a flow diagram of another exemplary method of compressing non-opaque HDR image data for storage in a LDR format render target in accordance with one or more aspects of the present invention. This method of the present invention may be used to produce images with HDR precision for all pixels, even those pixels that include non-opaque fragments. Specifically, alpha blending with compressed HDR channel values is performed at HDR precision and the blended channel values are not limited to a maximum value of one. In step 300 HDR image data for a fragment is received. In step 303 the method determines if the HDR image data indicates that the fragment is non-opaque, i.e., if alpha is less than one, and, if so, the method proceeds to step 307. If, in step 303 the method determines that the fragment is opaque, then the method proceeds to step 305 and determines the maximum channel value.

In step 307 destination (dst) data for the pixel corresponding to the fragment, e.g., compressed HDR data, is read from the LDR render target (background) and the HDR pixel data is reconstructed. Specifically, the compressed channel values and the compressed inverted maximum channel value are converted from the LDR format to the HDR format, e.g., converted from 8 bit fixed point to 16 bit floating point. The HDR color channels are then reconstructed by dividing each color channel by the HDR inverted maximum channel value. In step 308 the reconstructed destination HDR pixel color channels are blended with the fragment HDR color channel values to produce blended HDR channel values that are processed as the HDR image data for the fragment. Because the destination data is reconstructed to the HDR format and the blend operation is performed using the HDR range, the blended HDR channel values are not limited to the LDR range. Steps 310, 315, 317, 320, 325, 330, 335, 340, 355, and 360 are completed as previously described in conjunction with FIG. 3A.

As shown in the methods described in conjunction with FIGS. 1, 2A, 3A, and 3B, multisampled or non-multisampled HDR image data may be compressed and stored in an LDR render target. As shown in the method described in conjunction with FIG. 2B compressed HDR data that is multisampled may be read from the LDR render target and processed to produce compressed HDR data that is filtered. As shown in the method described in conjunction with FIG. 2C the compressed HDR data may be read from an LDR render target, reconstructed, and processed to produce reconstructed HDR images or post processed HDR images. Persons skilled in the art will appreciate that any system configured to perform the method steps of FIGS. 1, 2A, 2B, 2C, 3A, and 3B, or their equivalents, are within the scope of the present invention.

Compressing HDR image data into an LDR format may result in some loss since the LDR format has more limited precision than the HDR format and cannot be used to represent all of the values that can be represented by the HDR format. Therefore, the reconstructed HDR image data is not necessarily identical to the HDR image data prior to conversion to the LDR format. However, an important advantage of the present invention is that HDR image data that is within the range of values that can be represented by an LDR format (values between 0 and 1, inclusive) can be compressed and reconstructed without loss. In other words, if one is operating within the LDR precision the loss is effectively zero. Another advantage of the present invention is that when the range of values represented by the HDR image data is greater than one, the resulting losses are relatively small and typically are not noticed by a viewer. Thus, with the inventive technique, although the memory used to store the HDR image data is halved, the losses resulting from the conversion needed to store the HDR image data in an LDR render target are quite small—an unexpected result, especially in view of other "lossy" compression techniques.

Figure 4A:
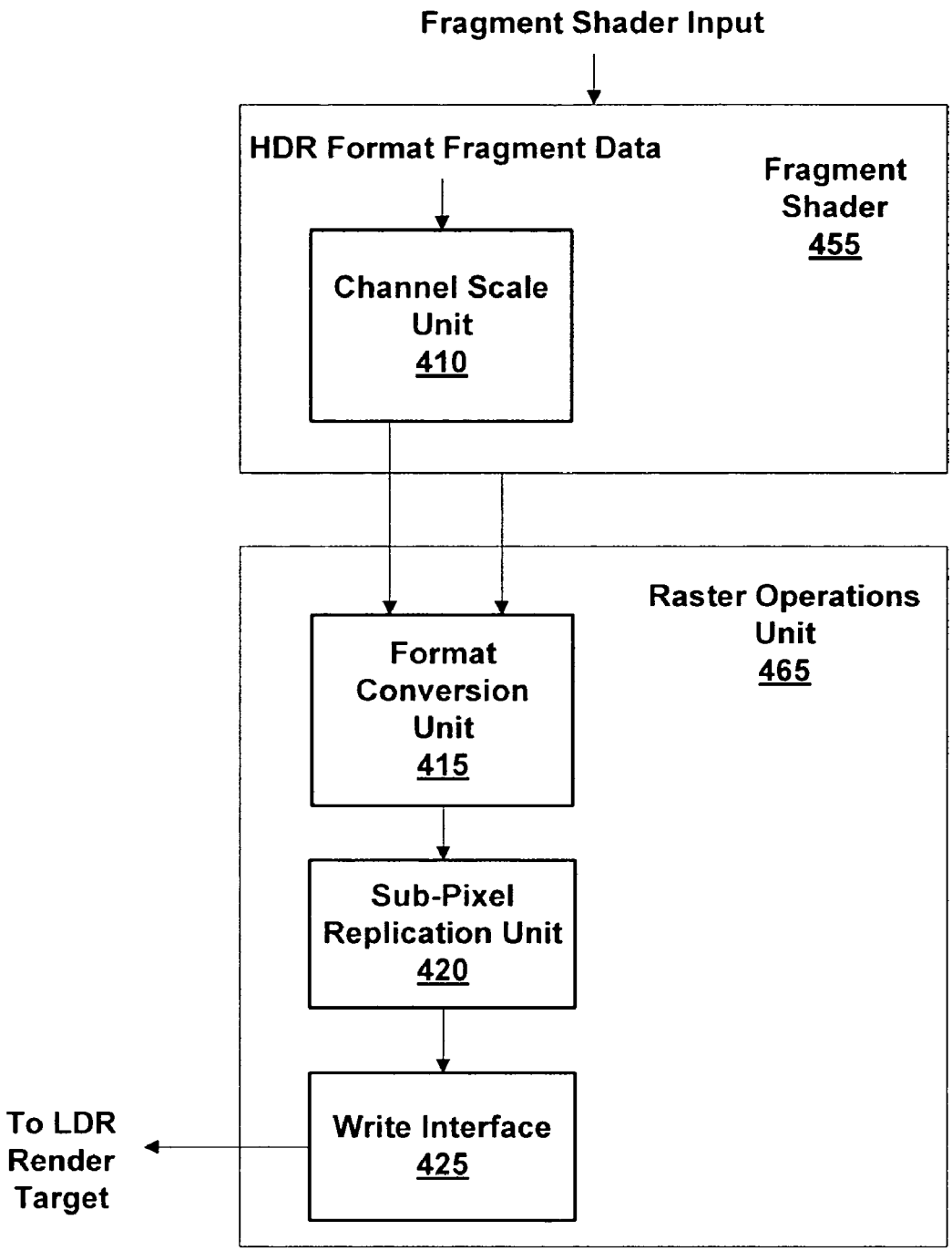
FIGS. 4A, 4B, and 4C are block diagrams of a portion of a graphics processor in accordance with one or more aspects of the present invention.

FIG. 4A is a block diagram of a portion of a graphics processor including a fragment shader 455 and a raster operations unit 465 in accordance with one or more aspects of the present invention. A fragment shader 455 receives fragment shader input, including parameters associated with fragments (color channels, alpha channels, sub-pixel coverage information, texture identifiers, texture coordinates, and the like) produced during rasterization of graphics primitives. Fragment shader 455 processes the fragment shader input to produce HDR image data, e.g., fragment data in an HDR format. Channel scale unit 410 is configured to receive the HDR image data, determine the maximum channel value, determine the inverted maximum channel value, and scale the channel values by the inverted maximum channel value. Channel scale unit 410 may be configured to perform steps 100, 105, 110, 115, 117, and 120 of FIG. 1. Channel scale unit 410 outputs the scaled channel values and the inverted maximum channel value to raster operations unit 465. In some embodiments of the present invention, the inverted maximum channel value may be output to raster operations unit 465 in the alpha channel. Fragment shader 455 passes the sub-pixel coverage information to raster operations unit 465. Fragment shader 455 may also output other fragment parameters to raster operations unit 465. Fragment shader 455 may also include other processing units configured to perform conventional shading operations specified by a shader program.

Raster operations unit 465 receives the scaled channel values, inverted maximum channel value, and sub-pixel coverage information from fragment shader 455 and converts the scaled channel values and inverted maximum channel value to produce compressed HDR channel data for output to an LDR render target. Raster operations unit 465 includes a format conversion unit 415 that may be configured to perform step 125 of FIG. 1. Raster operations unit 465 also includes a sub-pixel replication unit 420 that may be configured to perform step 210 of FIG. 2A, replicating the compressed HDR channel data based on the sub-pixel coverage information. In some embodiments of the present invention, sub-pixel replication unit 420 may be omitted.

Raster operations unit 465 includes a read interface (not shown) configured to output read requests to read from render targets stored in memory. In some embodiments of the present invention, raster operations unit 465 may include one or more cache memories configured to store data read from texture maps or render targets. Raster operations unit 465 includes a write interface 425 configured to store data, including compressed HDR image data, in one or more render targets stored in memory. Write interface 425 may be configured to perform steps 130 and 135 of FIG. 1 and steps 215 and 220 of FIG. 2A.

In addition to the sub-units shown in FIG. 4A, e.g. format conversion unit 415, sub-pixel replication 420, and write interface 425, raster operations unit 465 includes one or more processing units that may be configured to perform near and far plane clipping and raster operations, such as stencil, z test, blending, and the like, using fragment data received from fragment shader 455 and pixel data stored at a pixel position (image location specified by x,y coordinates) associated with the fragment data and read by raster operations unit 465.

Figure 4B:
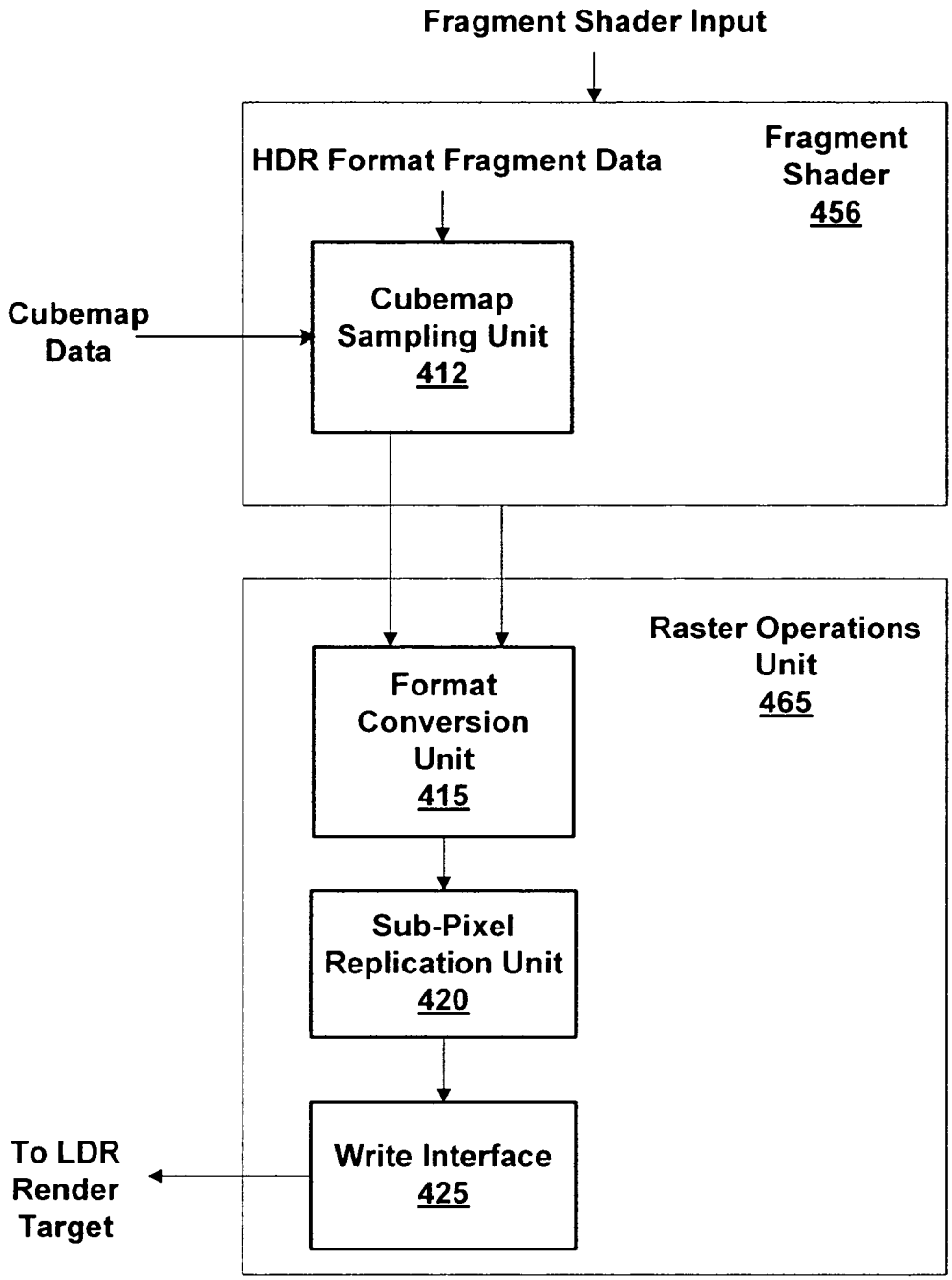

FIG. 4B is a block diagram of a portion of a graphics processor including another embodiment of a fragment shader, fragment shader 456, and raster operations unit 465 of FIG. 4A in accordance with one or more aspects of the present invention. Fragment shader 456 includes a cubemap sampling unit 412 that is configured to receive the HDR image data, determine the maximum channel value, and scale the channel values by the reciprocal of the maximum channel value by reading the scaled channel values from a specific cubemap configured to convert HDR data to an LDR format. Cubemap sampling unit 412 may be configured to perform steps 100, 105, 110, 115, 117, and 120 of FIG. 1. Cubemap sampling unit 412 outputs the scaled channel values and the inverted maximum channel value to raster operations unit 465. In some embodiments of the present invention, fragment shader 456 may include one or more cache memories configured to store texture read from memory, e.g. cubemap data. As previously described in conjunction with FIG. 4A, raster operations unit 465 includes a format conversion unit 415, a sub-pixel replication unit 420, and a write interface 425.

Figure 4C:
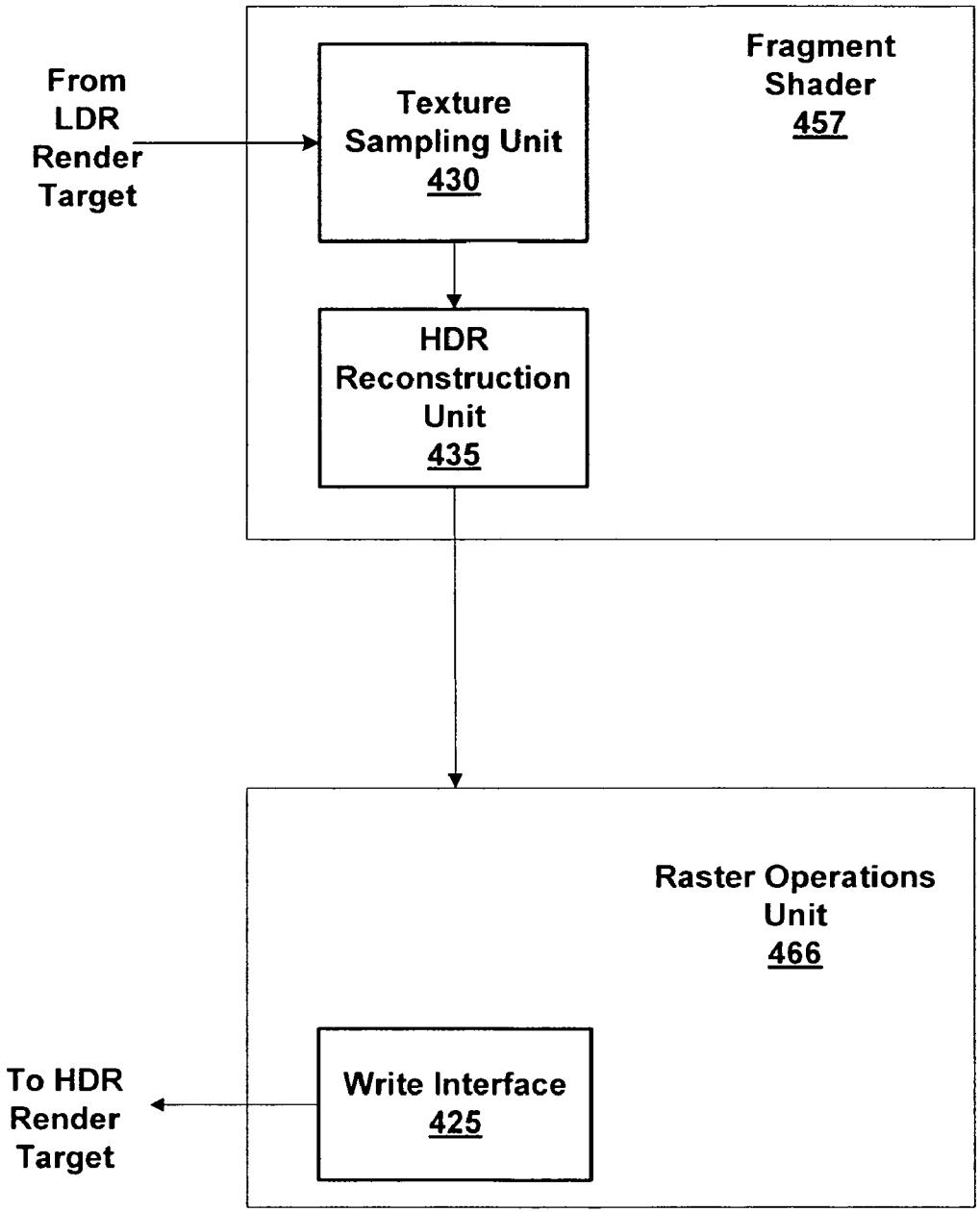

FIG. 4C is a block diagram of a portion of a graphics processor including other embodiments of a fragment shader and a raster operations unit, fragment shader 457 and raster operations unit 466, in accordance with one or more aspects of the present invention. Fragment shader 457 may also include the previously described sub-units, channel scale unit 410 and cubemap sampling unit 412 or other processing units configured to perform conventional shading operations specified by a shader program. Fragment shader 457 includes texture sampling unit 430 and HDR reconstruction unit 435. Texture sampling unit 430 is configured to sample (optionally filtered) image data, including compressed HDR image data, from texture maps in memory, including LDR or HDR format texture maps, or LDR or HDR render targets produced using the methods described in conjunction with FIG. 1, 2A, 2B, 2C, 3A, or 3B. HDR reconstruction unit 435 is configured to receive compressed HDR image data read from an LDR render target using texture sampling unit 430 and to reconstruct the HDR image data. HDR reconstruction unit 435 may be configured to perform step 250 of FIG. 2C. Other sub-units may be included in fragment shader 455 to perform step 260 of FIG. 2C and produce post processed HDR image data reconstructed from compressed HDR image data read as texture data.

The post processed or reconstructed HDR pixel data is output by fragment shader 457 to raster operations unit 466. Raster operations unit 466 may include one or more of the sub-units, format conversion unit 415, sub-pixel replication unit 420, and write interface 425, described in conjunction with FIG. 4A. Write interface 425 outputs the reconstructed HDR pixel data for storage in a render target. The render target may be an HDR render target. The reconstructed values may be manipulated (to achieve various HDR-based post processing effects) before writing to the render target, or they may be written to a true HDR render target and subsequently read again by fragment shader 457 and further processed by fragment shader 457 and/or raster operations unit 466 to perform various HDR-based post-processing tasks. These post processing tasks can include, but are not limited to, tasks such as tone mapping, exposure adaption, blue shift, blur, bloom, edge glow, depth of field, and the like.

Figure 5A:
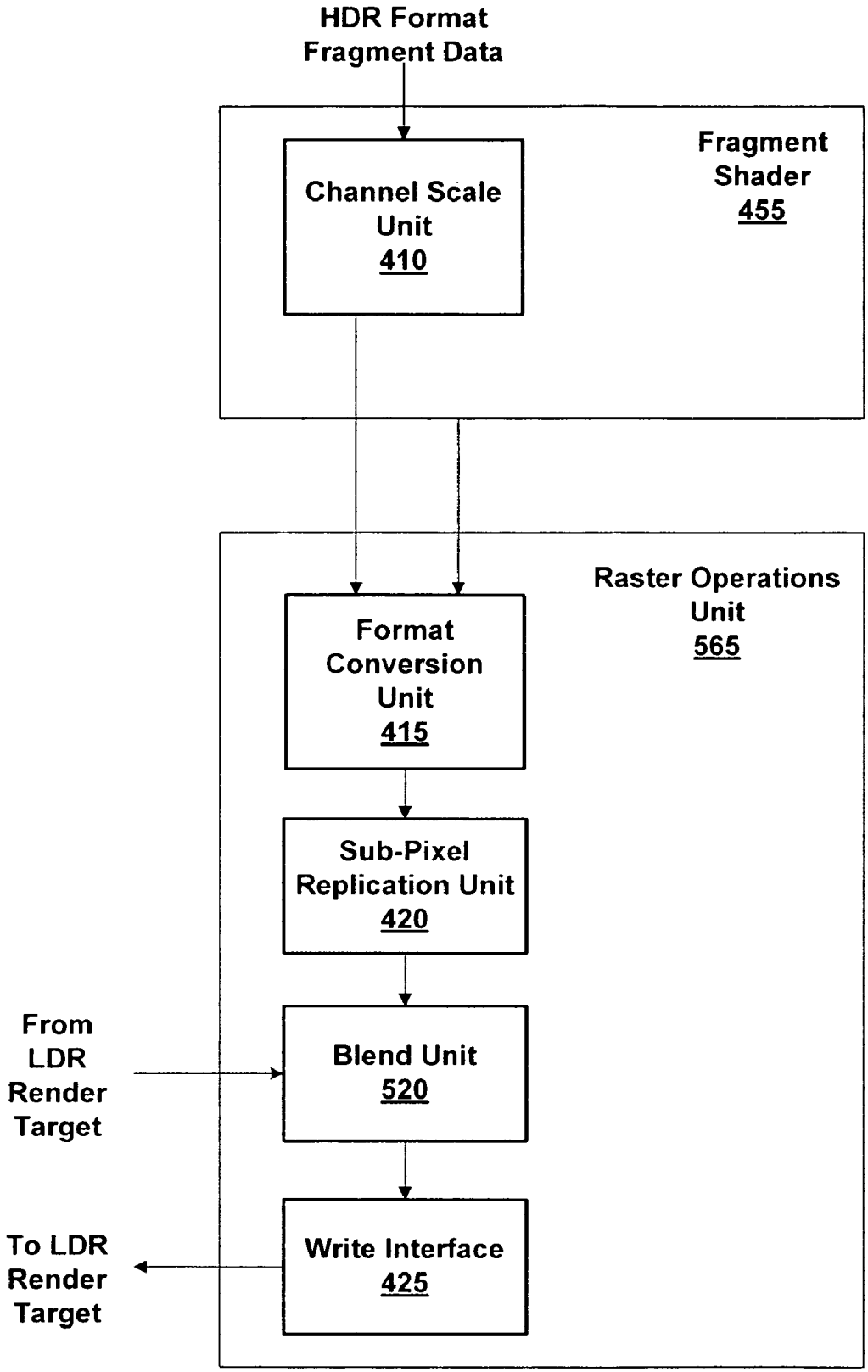
FIGS. 5A and 5B are other block diagrams of a portion of a graphics processor in accordance with one or more aspects of the present invention.

FIG. 5A is a block diagram of a portion of a graphics processor including fragment shader 455 of FIG. 4A and another embodiment of a raster operations unit, raster operations unit 565, in accordance with one or more aspects of the present invention. Fragment shader 455 may be configured to perform steps 300, 303, 305, 310, 315, 317, and 320 described in conjunction with FIG. 3A.

Raster operations unit 565 receives the scaled channel values, inverted maximum channel value, and coverage information from fragment shader 455. Raster operations unit 565 includes format conversion unit 415, sub-pixel replication unit 420, blend unit 520, and write interface 425. Raster operations unit 565 may include one or more other sub-units, such as a cache memory, processing units configured to perform conventional raster operations, or the like. In some embodiments of the present invention one or more of the sub-units, such as sub-pixel replication unit 420, may be omitted.

Format conversion unit 415 performs steps 325 and 340 of FIG. 3A. Blend unit 520 receives compressed HDR channel values for one or more sub-pixel positions that are covered by the fragment from sub-pixel replication unit 420. When the fragment is non-opaque, blend unit 520 reads the pixel data from the LDR render target and blends the pixel data with the compressed HDR channel values to produce compressed HDR channel values that include the blended pixel data. After the blend is performed a value of one is placed in the alpha channel of the compressed HDR channel values. When the fragment is opaque blend unit 520 outputs the compressed HDR channel values unchanged and the compressed inverted maximum channel value is placed in the alpha channel. Write interface 425 stores the compressed HDR channel values in the LDR render target.

Figure 5B:
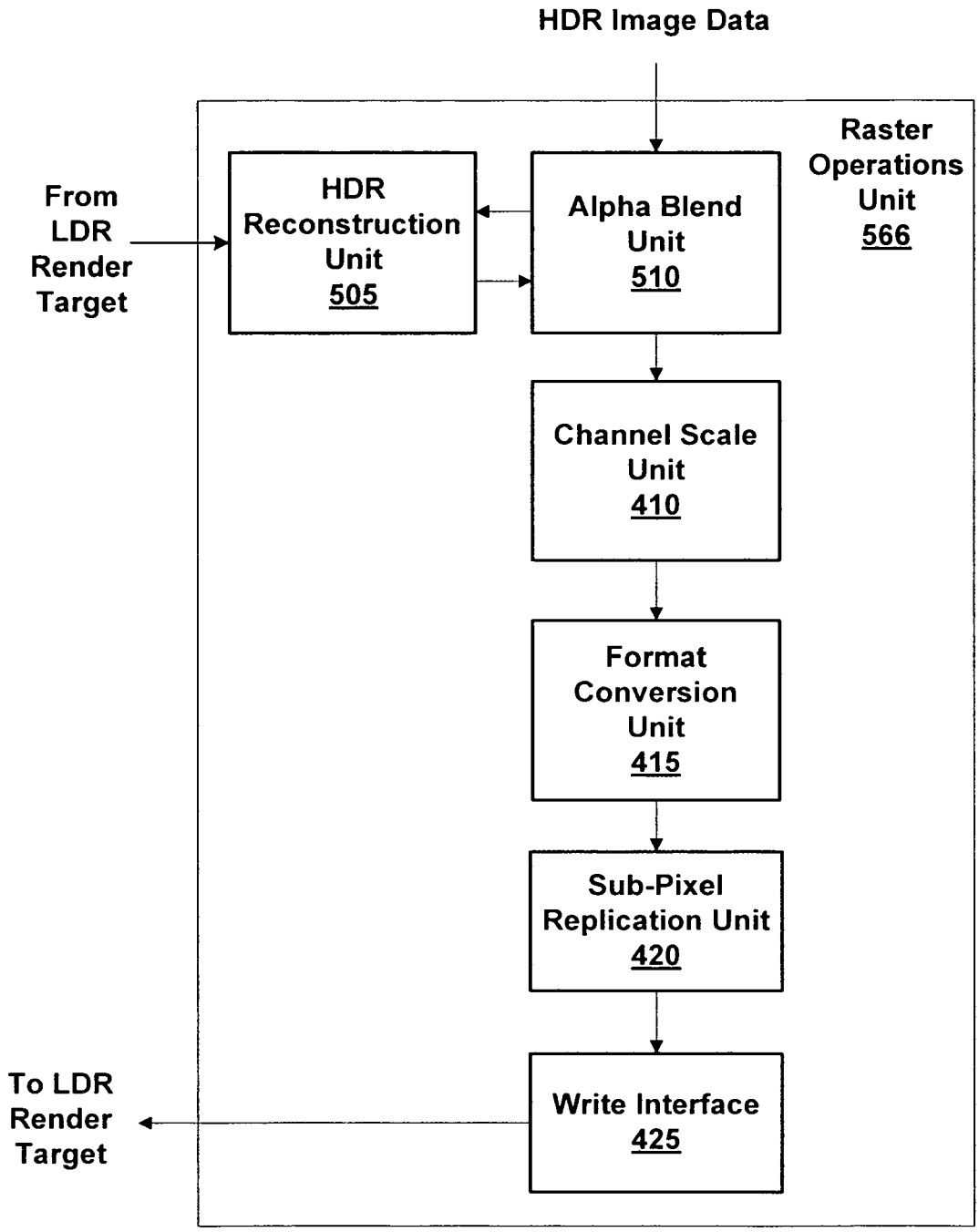

FIG. 5B is a block diagram of a portion of a graphics processor including another embodiment of a raster operations unit, raster operations unit 566, in accordance with one or more aspects of the present invention. Raster operations unit 566 includes HDR reconstruction unit 505, alpha blend unit 510, channel scale unit 410, format conversion unit 415, sub-pixel replication unit 420, and write interface 425. Raster operations unit 566 may include one or more other sub-units, such as a cache memory, processing units configured to perform conventional raster operations, or the like. In some embodiments of the present invention one or more of the sub-units, such as sub-pixel replication unit 420, may be omitted.

Raster operations unit 566 receives the HDR image data from another unit, such as fragment shader 455, 456, or 457. Alpha blend unit 510 may be configured to perform steps 300, 305, and 308 of FIG. 3B. In particular, alpha blend unit 510 requests the destination (background) pixel data from the LDR render target, via HDR reconstruction unit 505, when the HDR image data indicates that the fragment is non-opaque. HDR reconstruction unit 505 reads the pixel data from the LDR render target and reconstructs the HDR channel values, as described in conjunction with step 307 of FIG. 3B. Alpha blend unit 510 blends the pixel data with the HDR channel values for the fragment to produce properly blended HDR channel values. When the fragment is opaque alpha blend unit 510 outputs the HDR channel values unchanged. Note that because alpha blend unit 510 blends the HDR channel values in their uncompressed state, it will properly blend HDR channel values greater than one (unlike blend unit 520 of FIG. 5A). Therefore Channel scale unit 410 outputs the correct inverted maximum channel value to the alpha channel, instead of a value of one (unlike blend unit 520 of FIG. 5A).

Channel scale unit 410 receives the HDR channel values and coverage information and produces scaled channel values, the inverted maximum channel value, and coverage information. Channel scale unit 410 may be configured to perform steps 310, 315, 317, and 320 of FIG. 3B. Format conversion unit 415 may be configured to perform step 325 of FIG. 3B. Sub-pixel replication unit 420 replicates the compressed channel values according to the sub-pixel coverage information for the fragment. Write interface 425 stores the compressed HDR channel values in the LDR render target. The compressed HDR channel values may later be blended with additional HDR channel values, or filtered and processed to produce reconstructed HDR image data.

Figure 6:
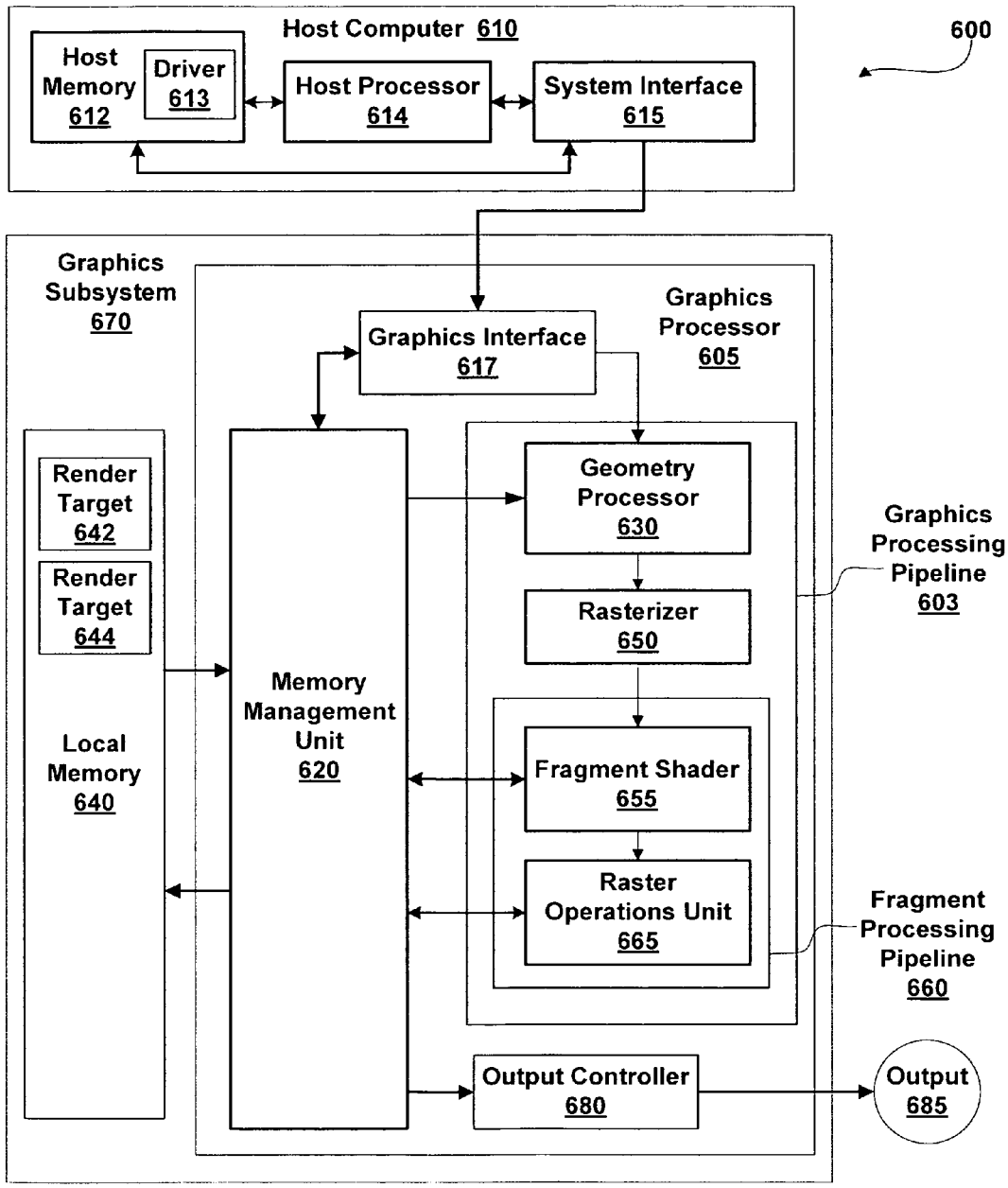
FIG. 6 is a block diagram of a graphics processing system in accordance with one or more aspects of the present invention.

FIG. 6 is a block diagram of an exemplary embodiment of a respective computer system, generally designated 600, and including a host computer 610 and a graphics subsystem 607 in accordance with one or more aspects of the present invention. Computing system 600 may be a desktop computer, server, laptop computer, palm-sized computer, tablet computer, game console, portable wireless terminal such as a PDA or cellular telephone, computer based simulator, or the like. Host computer 610 includes host processor 614 that may include a system memory controller to interface directly to host memory 612 or may communicate with host memory 612 through a system interface 615. System interface 615 may be an I/O (input/output) interface or a bridge device including the system memory controller to interface directly to host memory 612. An example of system interface 615 known in the art includes Intel® Northbridge.

A graphics device driver, driver 613, interfaces between processes executed by host processor 614, such as application programs, and a programmable graphics processor 605, translating program instructions as needed for execution by programmable graphics processor 605. Driver 613 also uses commands to configure sub-units within programmable graphics processor 605. Specifically, driver 613 may specify the format for each render target, e.g., number of bits per channel, number of channels, number of sub-pixel positions, floating point, fixed point, or the like.

Graphics subsystem 607 includes a local memory 640 and programmable graphics processor 605. Host computer 610 communicates with graphics subsystem 670 via system interface 615 and a graphics interface 617 within programmable graphics processor 605. Data, program instructions, and commands received at graphics interface 617 can be passed to a graphics processing pipeline 603 or written to a local memory 640 through memory management unit 620. Programmable graphics processor 605 uses memory to store graphics data, including texture maps, and program instructions, where graphics data is any data that is input to or output from computation units within programmable graphics processor 605. Graphics memory is any memory used to store graphics data, including render targets, or program instructions to be executed by programmable graphics processor 605. Graphics memory can include portions of host memory 612, local memory 640 directly coupled to programmable graphics processor 605, storage resources coupled to the computation units within programmable graphics processor 605, and the like. Storage resources can include register files, caches, FIFOs (first in first out memories), and the like.

In addition to Interface 617, programmable graphics processor 605 includes a graphics processing pipeline 603, a memory management unit 620 and an output controller 680. Data and program instructions received at interface 617 can be passed to a geometry processor 630 within graphics processing pipeline 603 or written to local memory 640 through memory management unit 620. In addition to communicating with local memory 640, and interface 617, memory management unit 620 also communicates with graphics processing pipeline 603 and output controller 680 through read and write interfaces in graphics processing pipeline 603 and a read interface in output controller 680.

Within graphics processing pipeline 603, geometry processor 630 and a programmable graphics fragment processing pipeline, fragment processing pipeline 660, perform a variety of computational functions. Some of these functions are table lookup, scalar and vector addition, multiplication, division, coordinate-system mapping, calculation of vector normals, tessellation, calculation of derivatives, interpolation, filtering, and the like. Geometry processor 630 and fragment processing pipeline 660 are optionally configured such that data processing operations are performed in multiple passes through graphics processing pipeline 603 or in multiple passes through fragment processing pipeline 660. Each pass through programmable graphics processor 605, graphics processing pipeline 603 or fragment processing pipeline 660 concludes with optional processing by a raster operations unit 665.

Vertex programs are sequences of vertex program instructions compiled by host processor 614 for execution within geometry processor 630 and rasterizer 650. Shader programs are sequences of shader program instructions compiled by host processor 614 for execution within fragment processing pipeline 660. Geometry processor 630 receives a stream of program instructions (vertex program instructions and shader program instructions) and data from interface 617 or memory management unit 620, and performs vector floating-point operations or other processing operations using the data. The program instructions configure subunits within geometry processor 630, rasterizer 650 and fragment processing pipeline 660. The program instructions and data are stored in graphics memory, e.g., portions of host memory 612, local memory 640, or storage resources within programmable graphics processor 605. When a portion of host memory 612 is used to store program instructions and data the portion of host memory 612 can be uncached so as to increase performance of access by programmable graphics processor 605. Alternatively, configuration information is written to registers within geometry processor 630, rasterizer 650 and fragment processing pipeline 660 using program instructions, encoded with the data, or the like.

Data processed by geometry processor 630 and program instructions are passed from geometry processor 630 to a rasterizer 650. Rasterizer 650 is a sampling unit that processes primitives and generates sub-primitive data, such as fragment data, including parameters associated with fragments (texture identifiers, texture coordinates, and the like). Rasterizer 650 converts the primitives into sub-primitive data by performing scan conversion on the data processed by geometry processor 630. Rasterizer 650 outputs fragment data, including sub-pixel coverage information, and shader program instructions to fragment processing pipeline 660.

The shader programs configure the fragment processing pipeline 660 to process fragment data by specifying computations and computation precision. Fragment shader 655 is optionally configured by shader program instructions such that fragment data processing operations are performed in multiple passes within fragment shader 655. Fragment shader 655 may perform the functions of previously described fragment shader 455, 456, 457 or 555. Specifically, fragment shader 655 may include one or more channel scale unit 410, cubemap sampling unit 412, HDR reconstruction unit 430, or filter unit 435. Texture map data may be applied to the fragment data using techniques known to those skilled in the art to produce shaded fragment data.

Fragment shader 655 outputs the shaded fragment data, e.g., scaled HDR channel values, maximum channel values, compressed HDR channel values, compressed inverted maximum channel values, sub-pixel coverage information, HDR image data, and depth, and codewords generated from shader program instructions to raster operations unit 665. Raster operations unit 665 includes a read interface and a write interface to memory management unit 620 through which raster operations unit 665 accesses data stored in local memory 640 or host memory 612. Raster operations unit 665 may perform the functions of previously described raster operations units 465, 466, 565, or 566. Specifically, raster operations unit 665 may include one or more format conversion unit 415, sub-pixel replication unit 420, write interface, channel scale unit 410, cubemap sampling unit 412, HDR reconstruction unit 550, alpha blend unit 510, or blend unit 520. Raster operations unit 665 optionally performs near and far plane clipping and raster operations, such as stencil, z test, blending, and the like, using the fragment data and pixel data stored in local memory 640 or host memory 612 at a pixel position (image location specified by x,y coordinates) associated with the processed fragment data. The output data from raster operations unit 665 is written back to local memory 640 or host memory 612 at the pixel position associated with the output data and the results, e.g., image data are saved in a render target stored in graphics memory.

When processing is completed, an output 685 of graphics subsystem 607 is provided using output controller 680. Alternatively, host processor 614 reads the image stored in local memory 640 through memory management unit 620, interface 617 and system interface 615. Output controller 680 is optionally configured by opcodes to deliver data to a display device, network, electronic control system, other computing system 600, other graphics subsystem 607, or the like.

The present invention may be used to compress HDR image data to an LDR format, thereby reducing the memory requirements needed to store the HDR image data. For example, 16 bit per channel HDR image data may be compressed to an 8 bit per channel LDR format, sometimes halving the memory requirement. Reducing the memory needed to store the image data may also result in performance improvement for processing the HDR data when the performance is limited by memory bandwidth.

The compressed HDR image data may be reconstructed without loss for channel values less than one. Channel values between one and five have small losses that are not easily perceived by a viewer. The compressed multisampled HDR image data may be filtered to produce a single-sample-per-pixel compressed HDR image, which may then be reconstructed into a filtered, uncompressed HDR image. Post processing functions, e.g., tone mapping, exposure adaption, blue shift, blur, bloom, edge glow, depth of field, and the like, may also be performed on the reconstructed HDR image data. The conversion and reconstruction method of FIGS. 1, 2A, 2B, 3A, and 3C may be performed by a shader program executed by conventional graphics processors or by graphics processors that include reconstruction support, particularly for alpha blending operations.

While the foregoing is directed to embodiments of the present invention, other and further embodiments of the invention may be devised without departing from the basic scope thereof, and the scope thereof is determined by the claims that follow. The foregoing description and drawings are, accordingly, to be regarded in an illustrative rather than a restrictive sense. The listing of steps in method claims do not imply performing the steps in any particular order, unless explicitly stated in the claim.

All trademarks are the respective property of their owners.

The invention claimed is:

1. A computer-implemented method of storing high dynamic range image data in a low dynamic range render target within a memory, comprising:

receiving the high dynamic range image data for a fragment that includes multiple channels;

determining a maximum channel value of the multiple channels;

inverting the maximum channel value and scaling the multiple channels by the inverted maximum channel value when the maximum channel value is greater than one;

processing, by a processing unit, the multiple channels and the maximum channel value to produce compressed channel values and a compressed inverted maximum channel value;

storing the compressed channel values in the low dynamic range render target within the memory; and storing the compressed inverted maximum channel value in an alpha channel of the low dynamic range render target within the memory.

2. The method of claim 1, wherein the compressed channel values and the compressed inverted maximum channel value are represented in a fixed point format.

3. The method of claim 2, wherein the fixed point format is 8 bits per channel.

4. The method of claim 1, wherein the step of determining the maximum channel value is performed by computing an index for a 2×2×2 cubemap centered on an origin using three of the multiple channels.

5. The method of claim 1, further comprising:

reading the compressed channel values from the low dynamic range render target; and dividing each one of the compressed channel values by the compressed inverted maximum channel value to produce reconstructed channel values.

6. The method of claim 5, further comprising blending the reconstructed channel values with additional high dynamic range channel values to produce blended channel values.

7. The method of claim 1, further comprising:

reading the compressed channel values from the low dynamic range render target, wherein the compressed channel values include compressed sub-pixel samples for a pixel of a high dynamic range image; and filtering the compressed channel values to produce filtered compressed channel values corresponding to the pixel of the high dynamic range image.

8. The method of claim 1, wherein the processing comprises:

scaling the multiple channels by a reciprocal of the maximum channel value to produce scaled channel values; and converting the scaled channel values and the reciprocal of the maximum channel value to a low dynamic range format to produce the compressed channel values.

9. The method of claim 1, wherein the multiple channels are represented in a floating point format.

10. The method of claim 1, further comprising setting the compressed inverted maximum channel value to one when the maximum channel value does not exceed one.

11. The method of claim 1, wherein the high dynamic range image data is represented in a floating point format of 16 bits or 32 bits per channel.

12. The method of claim 1, further comprising storing the compressed inverted maximum channel value in another low dynamic range render target.

13. The method of claim 1, further comprising storing a value of one in an alpha channel of the low dynamic range, render target when the high dynamic range image data indicates that the fragment is not opaque.

14. The method of claim 1, further comprising replicating the compressed channel values and compressed inverted maximum channel value to produce compressed channel values and compressed inverted maximum channel values corresponding to sub-pixel coverage information of the fragment.

15. A system for storing high dynamic range image data in a low dynamic range render target, comprising:

a channel scale unit configured to receive the high dynamic range image data and produce scaled channel values and an inverted maximum channel value for a fragment;

a format conversion unit coupled to the channel scale unit and configured to convert the scaled channel values and the inverted maximum channel value into a low dynamic range format to produce compressed high dynamic range channel values and a compressed inverted maximum channel value for the fragment; and a memory configured to store the compressed high dynamic range channel values in the low dynamic range render target and store the compressed inverted maximum channel value in an alpha channel of the low dynamic range render target.

16. The system of claim 15, further comprising a reconstruction unit configured to read the compressed high dynamic range channel values and the compressed inverted maximum channel value from the low dynamic range render target and to divide the compressed high dynamic range channel values by the compressed inverted maximum channel value to produce reconstructed high dynamic range channel values for a pixel including the fragment.

17. The system of claim 16, further comprising an alpha blend unit configured to combine the reconstructed high dynamic range channel values with additional high dynamic range image data to produce blended high dynamic range channel values for another fragment within the pixel.

18. The system of claim 15, further comprising a sub-pixel replication unit configured to replicate the compressed high dynamic range channel values for each sub-pixel that is covered by the fragment as indicated by sub-pixel coverage information to produce compressed multisampled high dynamic range channel values and compressed multisampled inverted maximum channel values for the fragment.

19. The system of claim 18, further comprising a texture sampling unit configured to filter the compressed multisampled channel values and compressed multisampled inverted maximum channel values to produce filtered compressed channel values for a pixel including the fragment.

20. The system of claim 15, further comprising a blend unit configured to combine the compressed high dynamic range channel values with additional compressed high dynamic range image data read from the low dynamic range render target to produce blended compressed high dynamic range channel values for another fragment.

21. The system of claim 15, wherein the channel scale unit comprises a cubemap sampling unit configured to index a cubemap by determining the maximum channel value and reading cubemap data that corresponds to the scaled channel values.

22. The system of claim 15, wherein the memory is further configured to store the compressed inverted maximum channel value in another low dynamic range render target.

23. The system of claim 15, wherein the channel scale unit is further configured to scale the multiple channels by a reciprocal of the maximum channel value to produce the scaled channel values when the maximum channel value is greater than one.

24. The system of claim 15, wherein the format conversion unit is further configured to set the compressed inverted maximum channel value to one when the maximum channel value does not exceed one.

25. The system of claim 15, wherein the high dynamic range image data is represented in a floating point format of 16 bits or 32 bits per channel.

* * * * *